United States Patent [19]

Hanyu

[11] 4,438,718

[45] Mar. 27, 1984

[54] PHASE INDICATION DEVICE OF SEWING MACHINE

[75] Inventor: Susumu Hanyu, Hachioji, Japan

[73] Assignee: Janome Sewing Machine Industry Co., Ltd., Japan

[21] Appl. No.: 372,854

[22] Filed: Apr. 28, 1982

[30] Foreign Application Priority Data

Apr. 28, 1981 [JP] Japan ..... 56-60572[U]

[51] Int. Cl.[3] ..... D05B 69/22

[52] U.S. Cl. ..... 112/274; 112/271; 112/121.11

[58] Field of Search ..... 112/275, 277, 121.11, 112/271, 274

[56] References Cited

U.S. PATENT DOCUMENTS 3,972,297 8/1976 Melcharick ..... 112/275
4,013,933 3/1977 Dohi et al. ..... 112/275
4,233,919 11/1980 Takahashi et al. ..... 112/277
4,254,724 3/1981 Conrads ..... 112/277

*Primary Examiner*—Werner H. Schroeder
*Assistant Examiner*—Steven N. Meyers
*Attorney, Agent, or Firm*—William A. Drucker

[57] ABSTRACT

A phase indication device of the invention is provided for a sewing machine for electrically indicating a predetermined angular position of a main drive shaft and showing that the sewing machine is ready for starting a stitching operation. The phase indication device comprises first and second detection means, electric circuit and an electric indicator. The first detection means produces a first electric signal when detecting the predetermined angular position of the main drive shaft. The second detection means produces a second electric signal when detecting the drive motor being deenergized. The electric circuit is operative to produce an output to lighten the electric indicator when the circuit receives both of the first and second electric signals.

5 Claims, 3 Drawing Figures

PHASE INDICATION DEVICE OF SEWING MACHINE

BACKGROUND OF THE INVENTION

The invention relates to a phase indication device of a sewing machine, and more particularly to a device for electrically indicating an optimum phase of the sewing machine for starting the sewing machine for a stitching operation.

It is generally required that the sewing machine is set in a predetermined optimum phase for starting the sewing machine for a stitching operation. If the sewing machine is started with a lagged starting phase the thread take-up lever will not suitably tighten the seams, resulting that the slackened seams are produced and that the jamming at the loop-taker is caused due to the slackened thread. On the other hand, if the sewing machine is started with an advanced starting phase the upper thread may be drawn out of a needle hole due to the upward movement of the thread take-up lever.

Hitherto, for preventing such undesirable phenomena, a drive motor with a brake device has been used to stop the sewing machine at a predetermined optimum phase at which the sewing machine is started again for the next stitching operation. Such a drive motor is, however, very expensive and disadvantageous for a massproduction of the sewing machines.

SUMMARY OF THE INVENTION

The invention has been provided to eliminate the defects and disadvantages of the prior art. It is therefore an object of the invention to provide a phase indication device for facilitating a stitching operation with a sewing machine.

It is another object of the invention to provide a novel phase indication device which is simple in structure and easy in operation and is produced at a reduced cost.

According to one aspect of the invention there is provided a phase indication device of a sewing machine substantially comprising first detection means for electrically detecting a predetermined angular position of the main drive shaft, thereby producing an electric signal; second detection means for electrically detecting a condition in which said drive motor is not driven, therby producing a second electric signal; electric circuit means operative to produce an output when both of said first and second electric signals are produced; and an electric indicator receiving said output of said electric circuit means to be indicative of said predetermined angular position of said main drive shaft.

BRIEF DESCRIPTION OF DRAWINGS

Further objects and advantages of the invention can be fully understood from the following description when read in conjunction with the accompanying drawings, in which.

PREFERRED EMBOCIMENT OF THE INVENTION

Figure 1:
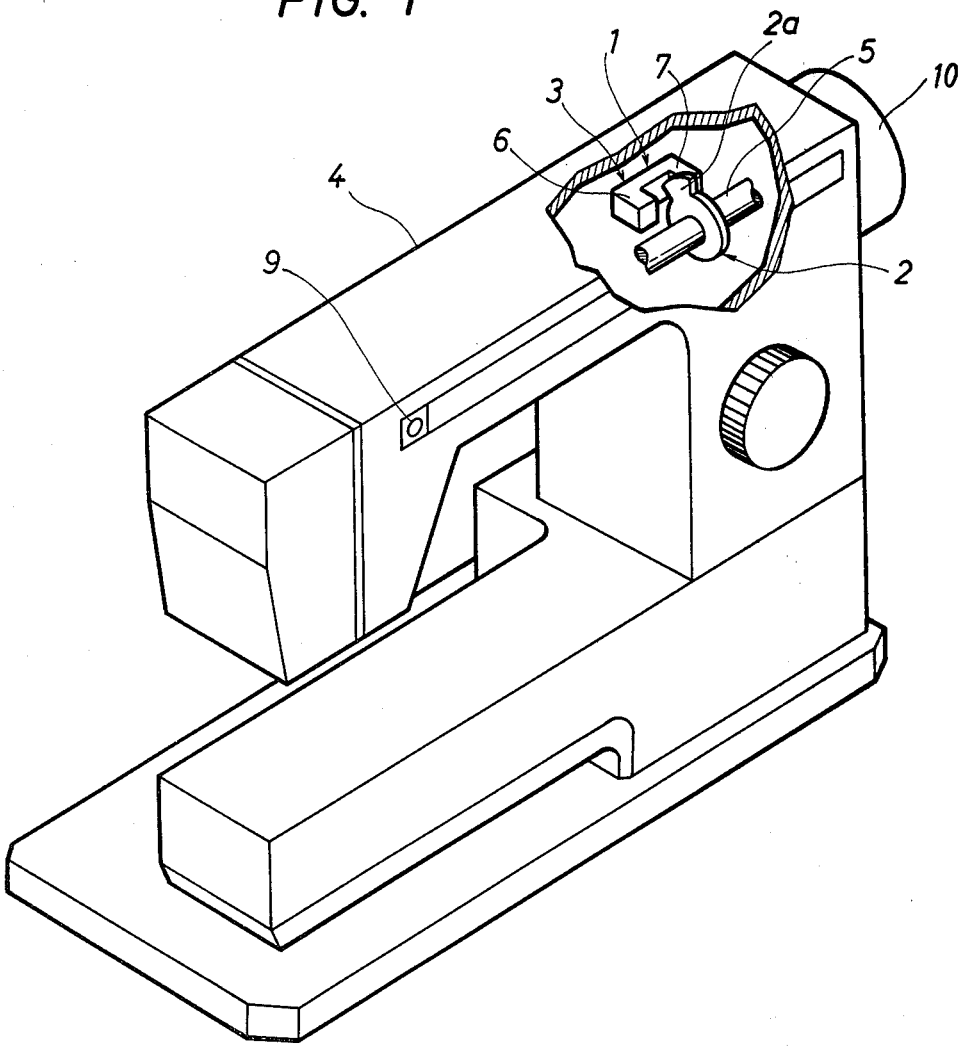
FIG. 1 is a schematic view, partly cutaway, showing a sewing machine provided with a phase indication device of the invention.
Figure 2:
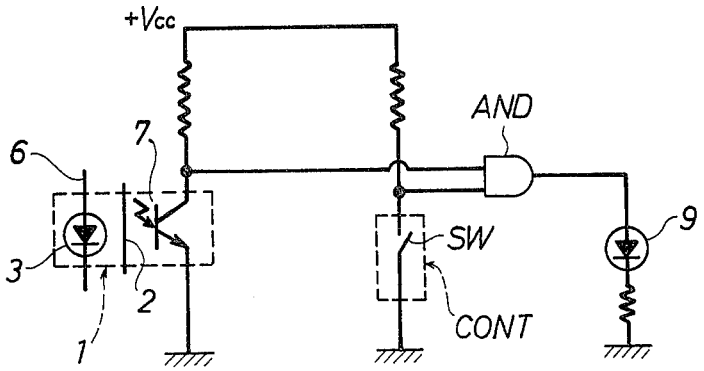
FIGS. 2 and 3 are circuit diagrams of the invention.
Figure 3:
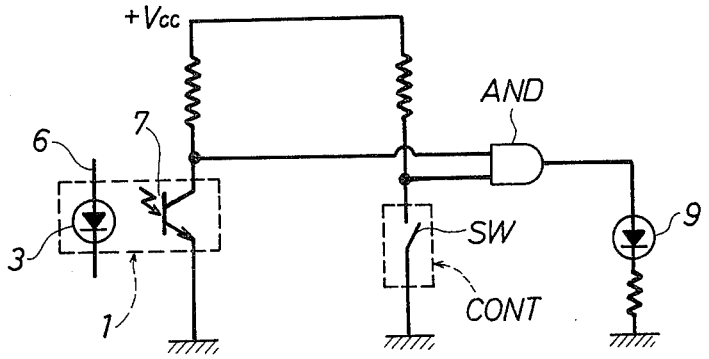

A preferred embodiment of the invention is shown in FIGS. 1 through 3. A detector 1 consists of a disc 2 with an outwrdly projected sector plate 2*a* and a photodevice 3 which is, as generally known, composed of a light emmiting diode 6 and a photo-transistor 7 arranged opposite to each other with a space provided therebetween. The disc 2 is secured to a main drive shaft 5, which is rotatably journalled in a housing 4 of a sewing machine for reciprocating a needle and a thread take-up lever. The photo-device 3 is secured to the housing 4 adjacent to the disc 2 in such a manner that the light projecting from the light emitting diode 6 toward the photo-transistor 7 will be interrupted by the sector plate 2*a* when the main drive shaft 5 occupies a predetermined angular position, showing that the sewing machine is ready for starting the stitching operation. A pulley 10 is secured to one end of the main shaft 5, projecting out from the housing 4, for manually operating the main drive shaft 5 and thus rotating the sector plate 2*a*. An indicator 9 by way of a light emitting diode is mounted on the front side of the housing 4.

FIG. 2 shows a circuit for controlling the indicator wherein the sector plate 2*a* is located between the light emitting diode 6 and the photo-transistor 7 so that the light therebetween is interrupted, whereas FIG. 3 shows the same circuit wherein the sector plate 2*a* is not interposed therebetween so that the photo-transistor receives the light of the light emitting diode. In these drawings, +Vcc represents a power supply to the control circuit, CONT a controller for controlling the rotation speed of a drive motor, SW a switch of the controller, AND an AND circuit, respectively.

The phase indication device of the invention with the abovementioned structure operates as follows.

If the machine operator manually rotates the pulley 10 until the detector 1 detects the optimum angular position of the main drive shaft 5 for starting the sewing machine, namely until the sector plate 2*a* interrupts the light from the light emitting diode 6 to the photo-transistor 7 as shown in FIG. 2, one input of the AND circuit, which is connected to the photo-transistor, becomes high level (logic 1), and the other input thereof, which is connected to the controller switch SW, is also high level because the controller CONT is not yet operated and is OFF. Therefore, the output of the AND circuit shows high level (logic 1), and then the indicator 9 is lightened to indicate that the sewing machine is set at the optimum phase for starting the sewing operation. On the other hand, when the sector plate 2*a* is not interposed between the light emitting diode and the photo-transistor as shown in FIG. 3, the one input of the AND circuit is low level (logic 0), and the other input thereof remains high level (logic 1) as far as the controller switch SW is OFF. Therefore, the output of the AND circuit is low level and then the indicator 9 is not lightened, namely indicating that the sewing machine is not in a suitable phase for starting the stitching operation.

If the controller CONT is operated to close the switch SW to start the sewing machine, the other input of the AND circuit, which is connected to the switch SW, becomes low level (logic 0), and therefore the output of the AND circuit is low level irrespectively of the logic value at the one input thereof connected to the photo-transistor. Accordingly, the indicator 9 remains inactive while the controller switch SW is ON.

I claim:

1. In a sewing machine having a main drive shaft rotated by a drive motor to vertically reciprocate a needle, a phase indication device comprising;

first detection means for electrically detecting a predeterminedf angular position of said main drive shaft, thereby producing a first electric signal;

second detection means for electrically detecting a condition in which said drive shaft is deenergized, thereby producing a second electric signal;

electric circuit means operative to produce an output when both of said first and second electric signals are produced; and an electric indicator receiving said output of said electric circuit means to be indicative of said predetermined angular position of said main drive shaft;

said second detection means including a switch which is closed and opened in association with operation of a speed controller of said sewing machine to energize and deenergize said drive motor, said switch being opened when said speed controller is not operated and thereby producing said second electric signal.

2. Device according to claim 1 wherein said first detection means comprises a sector plate secured to said main drive shaft for rotation therewith, a light emitting diode and a photo-transistor adopted to receive a light produced by said light emitting diode, said photo-transistor producing said first electric signal when the light produced by said light emitting diode is interrupted by said sector plate.

3. Device according to claim 1 wherein said electric circuit means includes an AND circuit, one input of which is connected to said first detection means and the other input of which is connected to said second detection means.

4. Device according to claim 1 wherein said second detection means is connected to a switch for energizing said drive motor.

5. Device according to claim 1 wherein said electric indicator comprises a light emitting diode.

* * * * *